US009238927B2

(12) United States Patent
Min

(10) Patent No.: US 9,238,927 B2
(45) Date of Patent: Jan. 19, 2016

(54) GEAR-DRIVEN CLUTCHING AND RESETTING DEVICE OF DOOR LOCK

(76) Inventor: Yu Min, Guangdong (CN)

( * ) Notice: Subject to any disclaimer, the term of this patent is extended or adjusted under 35 U.S.C. 154(b) by 897 days.

(21) Appl. No.: 13/508,408

(22) PCT Filed: Dec. 31, 2009

(86) PCT No.: PCT/CN2009/076311
§ 371 (c)(1),
(2), (4) Date: May 7, 2012

(87) PCT Pub. No.: WO2011/054163
PCT Pub. Date: May 12, 2011

(65) Prior Publication Data

US 2012/0223534 A1 Sep. 6, 2012

(30) Foreign Application Priority Data

Nov. 6, 2009 (CN) ..... 2009 2 0260077

(51) Int. Cl.

| | |
|---|---|
| ***E05C 19/00*** | (2006.01) |
| ***E05B 47/06*** | (2006.01) |
| ***E05B 13/00*** | (2006.01) |
| ***E05B 63/04*** | (2006.01) |
| *E05B 1/00* | (2006.01) |

(52) U.S. Cl.
CPC ..... *E05B 47/0692* (2013.01); *E05B 13/005* (2013.01); *E05B 63/04* (2013.01); *E05B 1/0007* (2013.01); *E05B 2001/0076* (2013.01); *Y10T 292/1052* (2015.04)

(58) Field of Classification Search
CPC ..... E05B 63/04; E05B 2001/0076; E05B 47/0692; E05B 13/005; E05B 1/0007; F16D 11/16
USPC ..... 292/22, 39, 51, 112, 160, 172, 142, 292/199, 279, 280; 74/440; 192/39, 71
See application file for complete search history.

(56) References Cited

U.S. PATENT DOCUMENTS

| | | | | |
|---|---|---|---|---|
| 2,928,288 | A * | 3/1960 | Bliss | G06M 1/163 235/139 R |
| 4,645,050 | A | 2/1987 | Ingenhoven | |
| 4,694,670 | A | 9/1987 | Jang | |
| 6,918,276 | B2 * | 7/2005 | Van Parys | 70/257 |
| 2008/0017466 | A1 * | 1/2008 | Min | 192/3.51 |

FOREIGN PATENT DOCUMENTS

| | | |
|---|---|---|
| CN | 2656565 | 11/2004 |
| CN | 2682155 | 3/2005 |

(Continued)

*Primary Examiner* — Kristina Fulton
*Assistant Examiner* — Christine M Mills
(74) *Attorney, Agent, or Firm* — Jacobson Holman, PLLC.

(57) ABSTRACT

A gear-driven clutching and resetting device of a door lock comprising a clutch 1, a rotary ring 2, a reset block 3, a reset spring 4, a reset block 5, and a locating pin 6. The clutch 1 is assembled inside the rotary ring 2, both of them rotate around the same center shaft. The reset spring 4 is fitted inside the reset block 5 which is in turn fitted inside the reset block 3, all three rotating around the same center shaft. A projection 61 of the locating pin 6 is fitted inside the groove 51 of the reset block 5, and has a limiting role on the reset block 5 when rotating. The gear 31 of the reset block 3 engages with the gear 11 of the clutch 1, thus realizing the transmission function between the reset block 3 and the clutch 1.

2 Claims, 5 Drawing Sheets

(56) References Cited

FOREIGN PATENT DOCUMENTS

| | | |
|---|---|---|
| CN | 2778990 | 5/2006 |
| CN | 2801996 | 8/2006 |
| CN | 1847587 | 10/2006 |
| GB | 918001 | 2/1963 |
| WO | 2009/060483 | 5/2009 |

* cited by examiner

GEAR-DRIVEN CLUTCHING AND RESETTING DEVICE OF DOOR LOCK

This is a national stage of PCT/CN09/076311 filed Dec. 31, 2009 and published in Chinese, which claims the priority of Chinese number 200920260077.7 filed Nov. 6, 2009, hereby incorporated by reference.

BACKGROUND OF THE INVENTION

The utility practical model is related to a gear-driven clutching and resetting device on a door lock, especially an all-gear-driven clutching and resetting device.

At present, there are a variety of clutching and resetting devices in the market.

The purpose of the utility practical model is to provide an all-gear-driven device that realizes clutching and resetting operations ingenious with mechanicals and geometric principles.

To achieve the above purpose, the technical scheme for the utility practical model is as follows:

A clutching and resetting device of a door lock that comprises a clutch, a rotary ring, a first reset block, a reset spring, a second reset block and a locating pin. The clutch is assembled inside the rotary ring, both of which rotate around the same center shaft. The reset spring is inside the second reset block, whereas the second reset block is inside the first reset block, with all three of them rotating around the same center shaft. The projection of the locating pin is fitted inside a groove in the reset block, so that the projection has a limiting role on the second reset block when the second reset block is rotating. The gear of the first reset block connects with the gear of the clutch, thus realizing the transmission function between the first reset block and the clutch.

The clutching and resetting device using the above gear has a simple structure, with a more flexible transmission function and enhanced reliability.

DETAILED DESCRIPTION OF THE INVENTION

Figure 1:
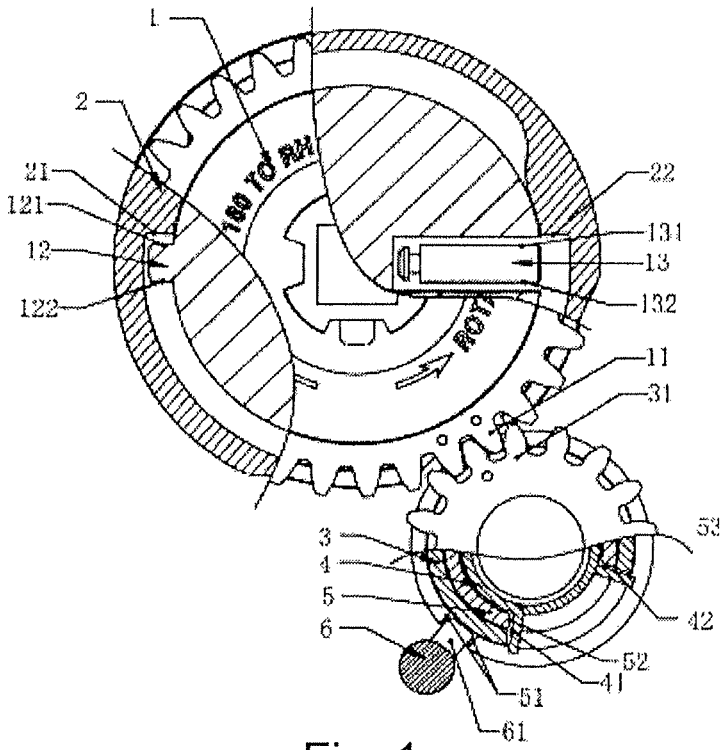
FIG. 1 and FIG. 2 Cross-section of reset block for inserting and withdrawing executive pin for right-hand opening FIG. 3 Cross-section for locking of right-hand-knob by counterclockwise rotation FIG. 4 Cross-section for unlocking of right-hand-knob by clockwise rotation FIG. 5 Cross-section for locking by clockwise rotation FIG. 6 and FIG. 7 Cross-section of reset block for inserting and withdrawing executive pin for left-hand-knob FIG. 8 Cross-section for locking of left-hand-knob by clockwise rotation FIG. 9 Cross-section for unlocking of left-hand-knob by counterclockwise rotation FIG. 10 Cross-section of conversion from right-hand-knob to left-hand opening

The utility practical model is further described as follows with reference to the figures:

A clutching and resetting device of a door lock that comprises a clutch 1, a rotary ring 2, a reset block 3, a reset spring 4, a reset block 5, and a locating pin 6. The clutch 1 is assembled inside the rotary ring 2, both of them rotate around the same center shaft. The reset spring 4 is fitted inside the reset block 5 whereas the reset block 5 is fitted inside the reset block 3, all three of them rotating around the same center shaft. The projection 61 of a locating pin 6 is installed inside a groove 51 of the reset block 5, so that the projection 61 has a limiting role on the reset block 5 when the reset block 5 is rotating.

In the above clutching and resetting device on a door lock, the gear 31 of the reset block 3 connects with the gear 11 of the clutch 1, thus realizing the transmission function between the reset block 3 and the clutch 1.

Figure 2:
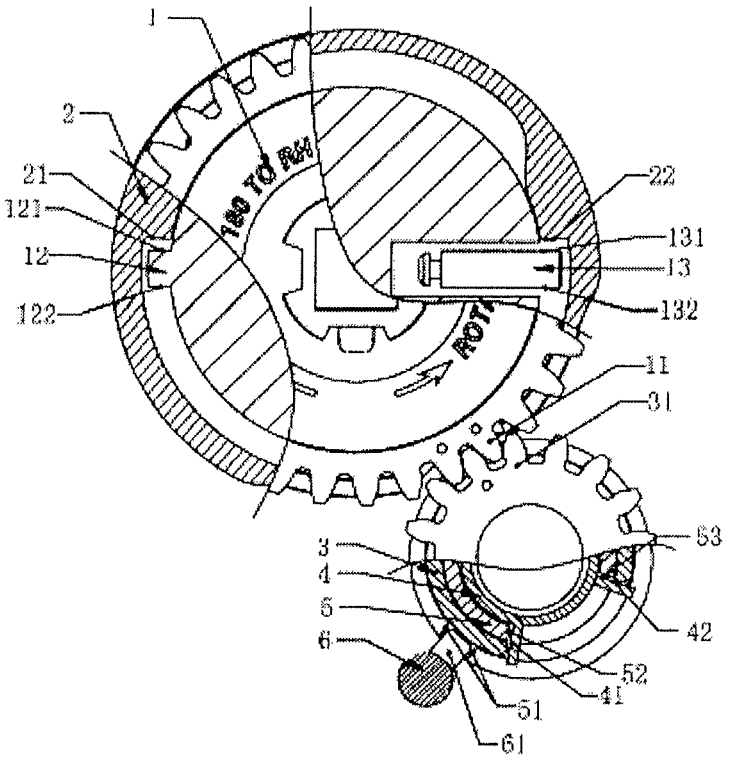

As shown in FIG. 1 and FIG. 2, a projection 12 and a pin 13 which can be stretched left and right and fitted inside the rotary ring 2 are on the clutch 1. A rib 121 and a rib 122 touch the projection 12, a rib 131 and a rib 132 touch the pin 13; and a rib 21 and a rib 22 are on the rotary ring 2.

Figure 3:
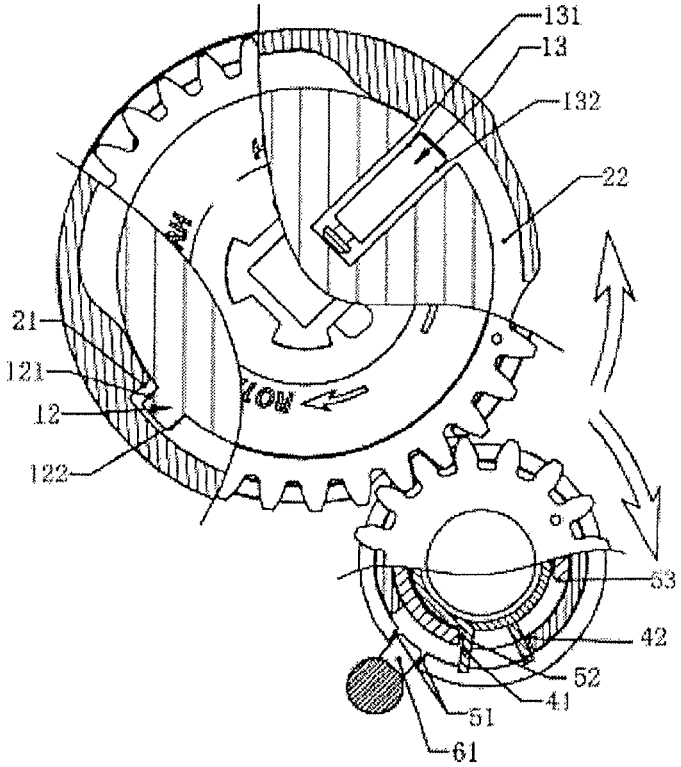

As shown in FIG. 3, when the rotary ring 2 rotates counterclockwise in a limiting trip with an angle less than 90 degrees, regardless of whether the pin 13 retracts or is outside the clutch 1, the rib 21 pushes against the rib 121, the rotary ring 2 drives the clutch 1 to rotate together counterclockwise, thus it plays a role of back lock. Meanwhile, the gear 31 on the reset block 3 engages with the gear 11 of the clutch 1, thus realizing running between the reset block 3 and the clutch 1. When the clutch 1 rotates counterclockwise, it drives the reset block 3 clockwise, and when the reset block 3 rotates clockwise, it imposes a clockwise circumferential force on the rib 42 of the reset spring 4 to force them to rotate clockwise together. At the same time the pin 6 is fitted inside the groove 51 of the reset block 5 through the projection 61, thus realize a locating function for the reset block 5. Therefore, the reset block 5 does not rotate clockwise together with the reset spring 4 and the rib 52 of the reset block 5 pushes against the rib 41 of the reset spring 4, thus compressing the reset spring 4 in the circumferential direction to generate a counterclockwise circumferential restoring force; promptly after finishing the back locking of both the rotary ring 2 and the clutch 1. The rotary ring 2 resets, the counterclockwise circumferential restoring force of the reset spring 4 acts in reverse on the reset block 3 to make the reset block 3 rotate counterclockwise, and then the clutch is reset back to the original position by the gear drive of the gear 31 and the gear 11.

Figure 4:
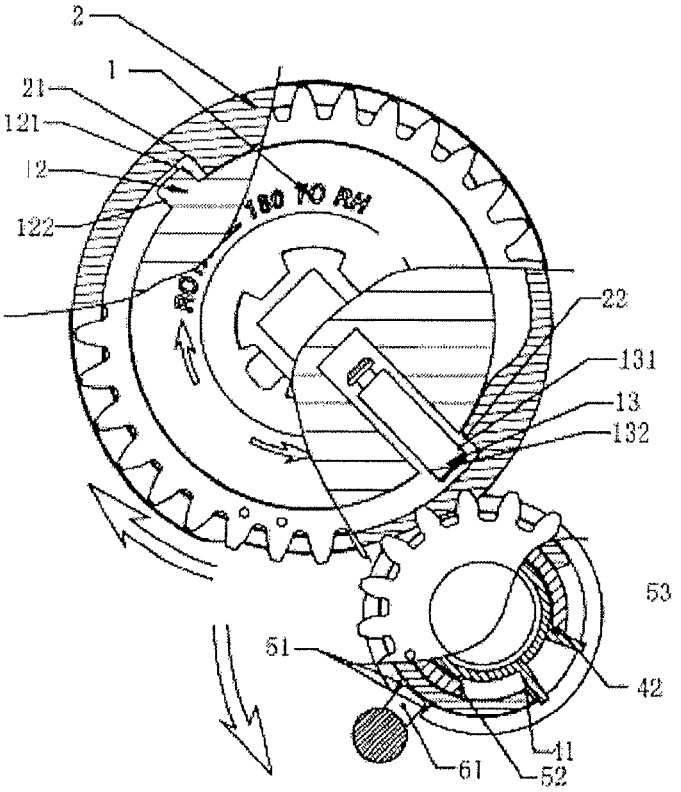

As shown in FIG. 4, when the rotary ring 2 rotates clockwise in a limiting stroke at an angle less than 90 degrees, and the pin 13 extends out of clutch 1, the rib 22 pushes against the rib 131, and the rotary ring 2 drives the clutch 1 to rotate together clockwise, thus it plays a role of unlock. Meanwhile, the reset block 3 engages with the clutch 1 through the gear drive of the gear 31 and the gear 11. Therefore, the clutch 1 drives the reset block 3 to rotate counterclockwise when it rotates clockwise. When the reset block 3 rotates clockwise, it imposes a counterclockwise circumferential force on the rib 41 of the reset spring 4 which forces the rib 41 of the reset spring 4 to rotate together counterclockwise. At the same time the pin 6 is fitted inside the groove 51 of the reset block 5 through the projection 61, thus realizing the locating function for the reset block 5. Therefore, the reset block 5 does not rotate counterclockwise together with the reset spring 4 and the rib 53 of the reset block 5 pushes against the rib 42 of the reset spring 4, thus compressing the reset spring 4 towards the circumferential direction, and generates a clockwise circumferential restoring force; after finishing the locking action of both the rotary ring 2 and the clutch 1. The rotary ring 2 resets, the clockwise circumferential restoring force generating from the reset spring 4 acts in reverse on the reset block 3 to make the reset block 3 rotate clockwise, and then the clutch 1 is reset back to the original position through the gear drive of the gear 31 and the gear 11.

Figure 5:
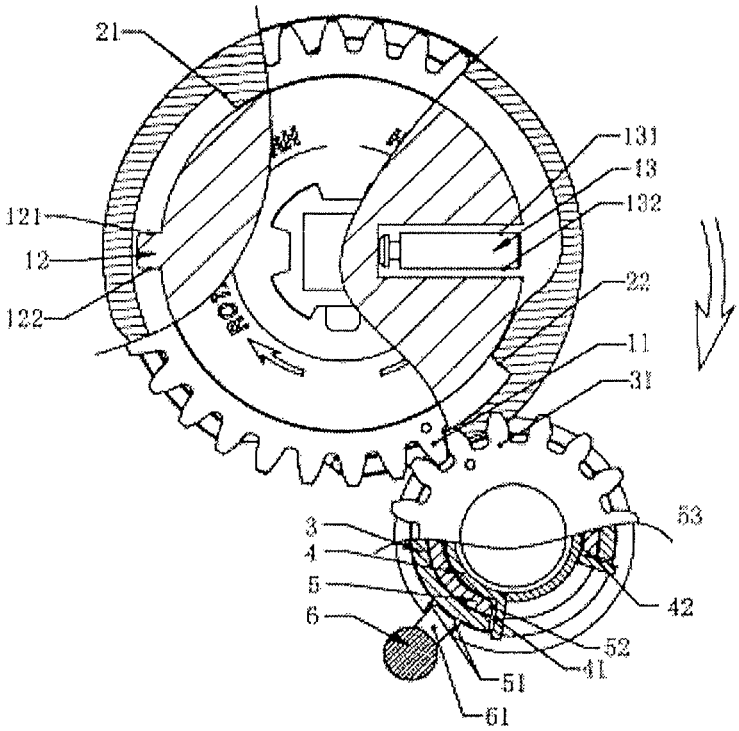

As shown in FIG. 5, when the rotary ring 2 rotates clockwise in a limiting stroke with an angle less than 90 degrees, the executive pin 13 retracts into the clutch 1, the rib 22 does not push against the rib 131, and now the rotary ring 2 cannot drive the clutch 1 to rotate together clockwise, so that the door cannot be unlocked and remains in the locked state.

As shown in FIG. 6, FIG. 7, FIG. 8 and FIG. 9, the principles for a Left-Open-Door-Knob and a Right-Open-Door-Knob are the same but the results are opposite, i.e., unlocking by rotating counterclockwise and back locking by rotating clockwise.

Figure 6:
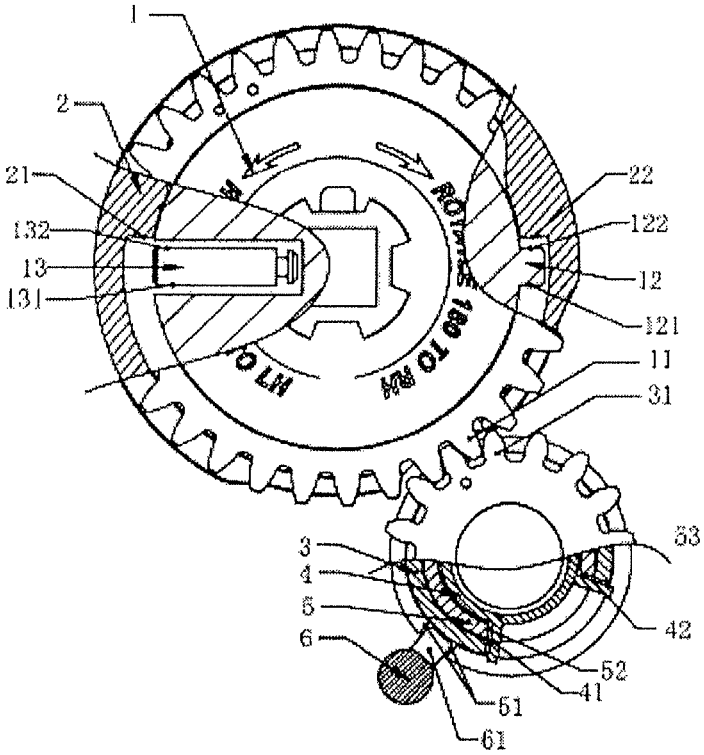
Figure 7:
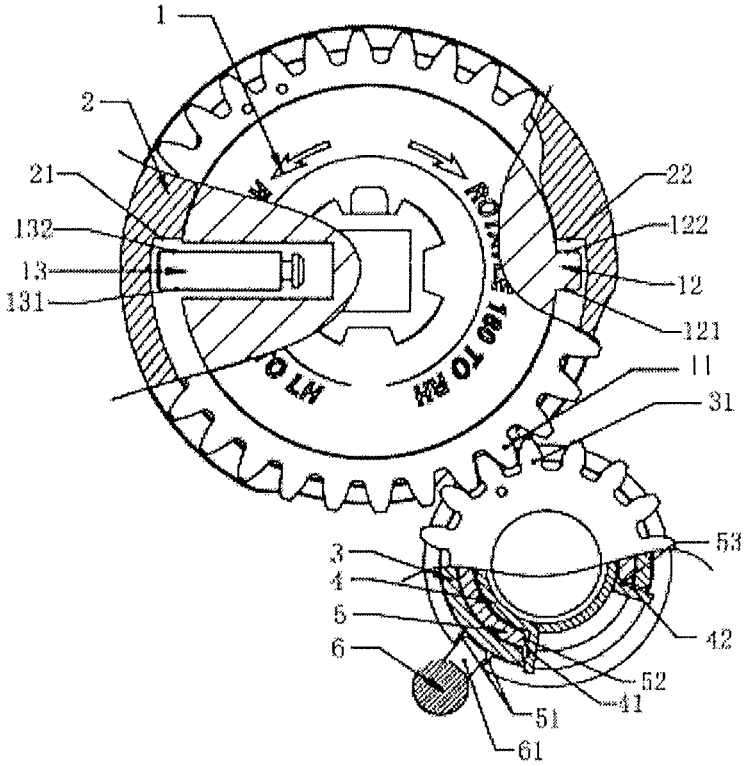
Figure 8:
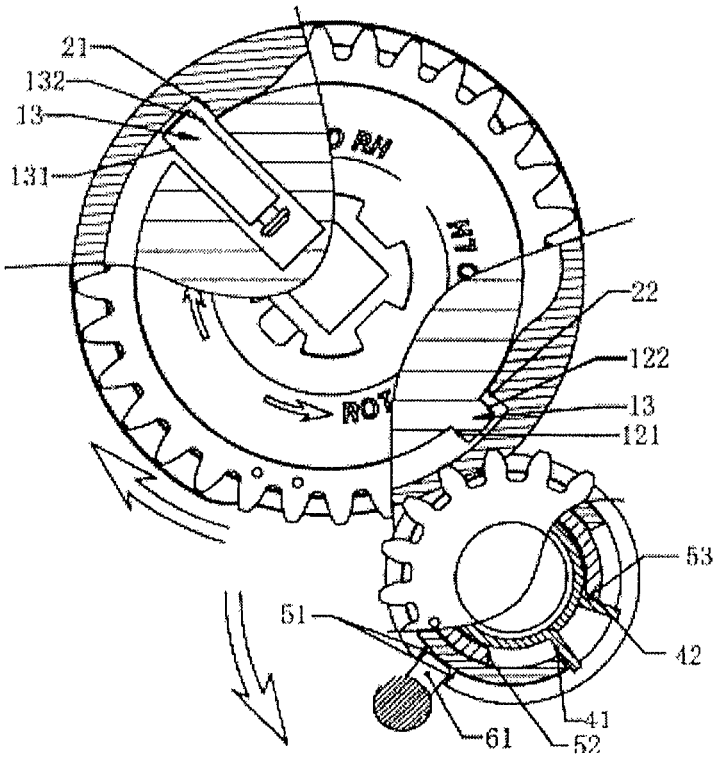
Figure 9:
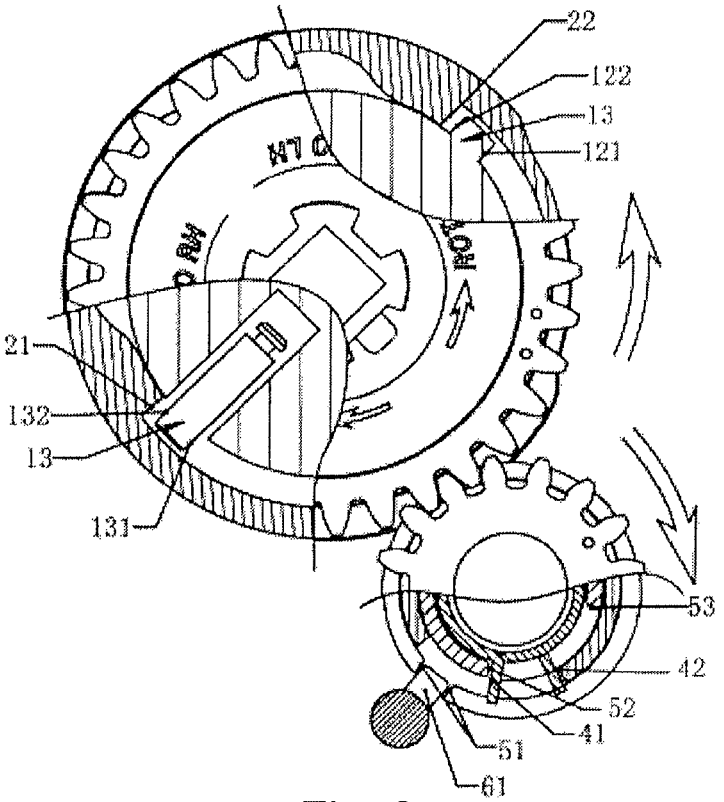
Figure 10:
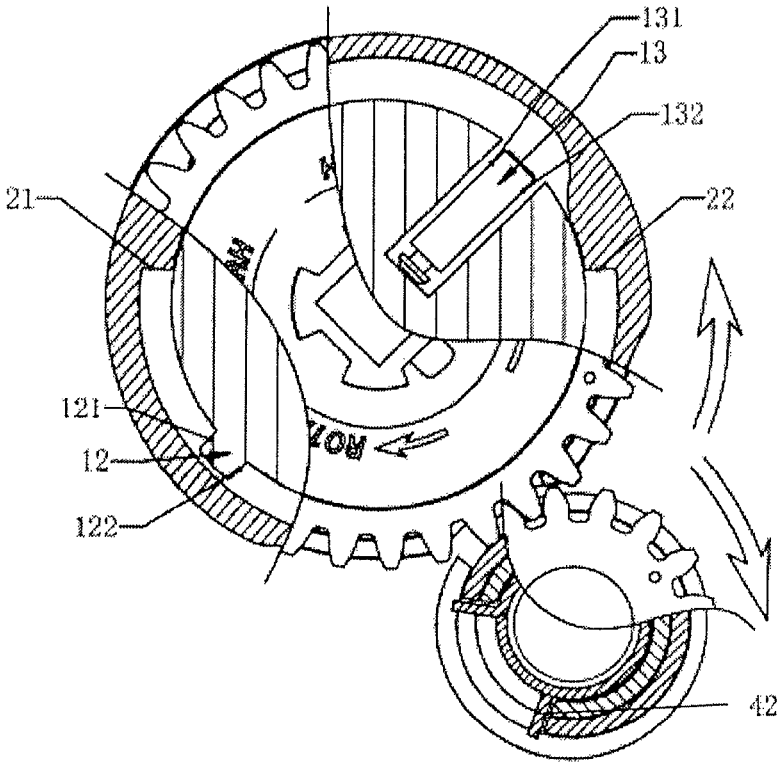

As the Right-Open-Door-Knob shown in FIG. 10, when the locating pin 6 is subjected to an externally acting force and causes the projection 61 to separate from the groove 51, the reset block 5 will not be fixed into position, so that the reset block 5 can rotate circumferentially. When the pin 13 of the clutch 1 retracts into the clutch 1, the rib 131 does not push against the rib 22; when the clutch rotates by 180° counterclockwise, rib 122 pushes against rib 22, and the Right-Open-Door-Knob is changed into Left-Open-Door-Knob. The gear drive of the gear 31 and the gear 11, the clutch 1 drives the reset block 5 to rotate clockwise and drives the reset block 3 to rotate together with the reset spring 4 when rotating counterclockwise. Since the number of teeth for the gear 31 is twice that of the gear 11, according to the principle of the gear drive, the clutch 1 drives the reset block 5 and reset block 3 to rotate 360° clockwise together with the reset spring 4 to return to the original position when rotating 180° counterclockwise. After the outside acting force on the locating pin 6 is removed, the locating pin 6 is fitted inside the groove 51 of the reset block 5 through the projection 61, thus realizing the positioning function for the reset block 5 by fixing the projection 61 (as shown in FIG. 6).

When the Left-Open-Door-Knob is changed into the Right-Open-Door-Knob, the principle is the same as that in the above description, i.e., the Left-Open-Door-Knob can be changed into the Right-Open-Door-Knob when the clutch 1 rotates 180° clockwise.

The invention claimed is:

1. A gear-driven clutching and resetting device of a door lock comprising a clutch, a rotary ring, a first reset block, an arch shape reset spring, a second reset block, and a locating pin, whereas the clutch is assembled inside the rotary ring, the clutch and the rotary ring coaxially rotate around a first center shaft; the reset spring is fitted inside the second reset block, whereas the second reset block is fitted inside the first reset block; the reset spring, the second reset block and the first reset block coaxially rotate around a second center shaft, wherein a radius of the rest spring is shorter than a radius of the second reset block and the radius of the second reset block is shorter than a radius of the first reset block; a projection of the locating pin is fitted inside a groove of the second reset block, so that the projection has a limiting function on the second reset block when the second reset block is rotating.

2. The gear-driven clutching and resetting device of a door lock, as claimed in claim 1, wherein a gear of the first reset block engages with a gear of the clutch, thus realizing a transmission function between the first reset block and the clutch.

* * * * *